US005909817A

United States Patent [19]

Wallace, Jr. et al.

[11] Patent Number: 5,909,817

[45] Date of Patent: Jun. 8, 1999

[54] METHOD AND APPARATUS FOR CONTROLLING AND OPERATING A CONTAINER CRANE OR OTHER SIMILAR CRANES

[75] Inventors: Walter J. Wallace, Jr., Alameda; Mark A. Wallace, Hayward, both of Calif.

[73] Assignee: Geotech Crane Controls, Inc., Alameda, Calif.

[21] Appl. No.: 08/960,643

[22] Filed: Oct. 30, 1997

Related U.S. Application Data

[62] Division of application No. 08/542,074, Oct. 12, 1995, Pat. No. 5,713,477.

[51] Int. Cl.[6] ..... B66C 13/06

[52] U.S. Cl. ..... 212/275; 212/270; 212/273; 212/274

[58] Field of Search ..... 212/270, 274, 212/275, 273

[56] References Cited

U.S. PATENT DOCUMENTS

| | | |
|---|---|---|
| 3,351,213 | 11/1967 | Newman et al. . |
| 3,517,830 | 6/1970 | Virkkala . |
| 3,899,083 | 8/1975 | Flessner et al. . |
| 3,921,818 | 11/1975 | Yamaguishi . |
| 4,512,711 | 4/1985 | Ling et al. . |
| 4,756,432 | 7/1988 | Kawashima et al. . |
| 4,997,095 | 3/1991 | Jones et al. . |
| 5,089,972 | 2/1992 | Nachman et al. . |
| 5,117,992 | 6/1992 | Simkus, Jr. et al. . |
| 5,127,533 | 7/1992 | Virkkunen . |
| 5,142,658 | 8/1992 | McMorran et al. . |
| 5,152,408 | 10/1992 | Tax et al. . |
| 5,219,420 | 6/1993 | Kiishki et al. . |

FOREIGN PATENT DOCUMENTS

| | | |
|---|---|---|
| 52-25358 | 2/1977 | Japan . |

OTHER PUBLICATIONS

Published paper entitled *Automated Container Handling—A Step into the Future* by C. D. Ramsden, President and General Manager of PACECO, a division of Fruehauf Corporation. It is believed that this paper was read by Mr. Ramsden at the 1970 meeting of the American Association of Ports in Montreal, Quebec, Canada and was published in the proceedings of said meeting as pp. 79–85.

Publication entitled *Bulk Handling at Ocean Ports,* by John F. Oyler, pp. 586–593, presented at the Seminar on Transportation Systems for Bulk Solids, University of Pittsburgh, Dec. 6–7, 1972.

*Primary Examiner*—Thomas J. Brahan

*Attorney, Agent, or Firm*—Palmatier & Zummer

[57] ABSTRACT

The crane comprises a generally horizontal boom or other supporting structure having at least one rail thereon, a trolley having a reversible drive for moving the trolley in either direction along the rail, a wire rope hoist suspended from the trolley, and a load carrying device suspended from the hoist for selectively grasping and releasing a freight container or some other load. The crane has a control system which causes the trolley drive to stop the trolley momentarily at a first stopping position. Due to the control system, the drive then restarts the trolley and stops it at a second stopping position directly over a transfer position where the load is to be delivered and released. If the load is a freight container, the transfer position may be directly over a cell of a container ship. The control system includes an encoder for determining the length of the pendulum comprising the trolley, the hoist, the load carrying device and the load. The stopping of the trolley at the first stopping position causes the load to swing forwardly into the first quarter of a pendulum swinging cycle. The control system includes means for adjusting the distance between the first and second stopping positions to correspond with the horizontal component of distance traveled by the load during the first quarter of the pendulum cycle.

12 Claims, 10 Drawing Sheets

METHOD AND APPARATUS FOR CONTROLLING AND OPERATING A CONTAINER CRANE OR OTHER SIMILAR CRANES

This application is a division of application Ser. No. 08/542,074, filed Oct. 12, 1995 now U.S. Pat. No. 5,713, 477.

FIELD OF THE INVENTION

This invention relates to a method and apparatus for controlling and operating a container crane or other similar cranes of a type having a generally horizontal boom or some other horizontal supporting structure, a trolley which can be translated in either direction along the supporting structure, and hoisting means suspended from the trolley and comprising a system of wire ropes and a load carrying device suspended by the wire ropes whereby a standard freight container, bulk materials or other loads can be picked up, hoisted upwardly toward the trolley, carried by the trolley along the boom, stopped motionless at a desired position without any residual swinging movement, lowered to a selected location, and deposited in such location. The present invention makes it possible to pick up, hoist, transport, lower and deposit a container or other load with a high degree of accuracy and in a minimum amount of time without any difficulty arising from residual swinging movement of the load.

BACKGROUND OF THE INVENTION

Gantry-type cranes are often outfitted to serve as container cranes for loading standard freight containers into container ships, and also for unloading the containers from the ships. Typically, a container ship has a large number of cells or compartments in which standard freight containers can be received with only a minimum of clearance, and can be stacked vertically until the cells are full. In order to lower a freight container into a cell, the container must be positioned with a high degree of accuracy over the cell so that the container can be lowered directly into the cell without bumping the deck of the ship or the walls of the cell to any objectionable extent. A gantry-type container crane comprises a substantially horizontal supporting structure or boom with rails thereon along which a trolley is moveable in either direction by an electrically controlled power drive. A hoisting means or system is suspended from the trolley and is moveable horizontally therewith. The hoisting system comprises a system of wire ropes hanging downwardly from the trolley and connected to a load carrying device, preferably a spreader bar grasping device for selectively grasping and releasing a freight container.

A container crane is well adapted for unloading containers from railroad cars or semi-trailer trucks and for loading the containers into the cells of a container ship. In a typical sequence of operations, the trolley is moved horizontally along the boom and is stopped directly over a container on a waiting semi-trailer truck. The spreader bar is lowered by the hoisting system into engagement with the container and is actuated so as to grasp the container, which is then hoisted to a safe elevation so that the container will clear any obstacles on the dock or the container ship. The trolley is then moved outwardly along the boom and over the container ship until the trolley is over the cell into which the container is to be loaded. The object of this maneuvering is to enable the container to be lowered by the hoisting system directly into the cell.

However, considerable difficulty has been experienced by crane operators in aligning the container with the cell with sufficient accuracy to enable the container to be lowered into the cell without any objectionable bumping of the container against the deck of the ship or the walls of the cell. This difficulty arises from the fact that the container starts to swing like the bob of a pendulum when the trolley is stopped. The container may swing through several pendulum cycles before the swinging movement is dissipated sufficiently to enable the crane operator to lower the container into the cell. The trolley constitutes the pivotal support for the pendulum. The suspension means are formed by the hoisting rope system, and the bob is formed by the container and the spreader bar. The problem arising from the pendulum swinging of the container has been widely recognized, but no satisfactory solution has heretofore been devised.

SUMMARY OF THE INVENTION

One object of the present invention is to provide a method of stopping the pendulum swinging movement of the container or other load so that the container can be stopped motionless in a transfer position, directly over the cell, with a minimum expenditure of time and energy.

A further object is to provide a new and improved control system for the crane whereby the novel method of the present invention is implemented and the container is stopped from swinging with an automatic series of operations.

In accordance with the method of the present invention, the pendulum swinging movement of the container is eliminated by stopping the trolley not once but twice in quick succession. The second stop of the trolley is directly over the cell into which the container is to be lowered. The first stop of the trolley is at a position short of the second and final position which is directly over the cell. The trolley is stopped only momentarily at the first position. The trolley is then moved at a controlled rate to the second stopping position, directly over the cell in the container ship.

When the trolley is stopped at the first position, the container does not stop, but rather starts to swing forward like the bob of a pendulum. The trolley is then moved forward at a controlled rate such that the trolley catches up with the container at the extreme end point of its first quarter arc of the complete pendulum cycle, at which point the pendulum comes to a pause and stops. The time interval between the first and second stops of the trolley corresponds to the first quarter of the complete pendulum swinging cycle, if the container were allowed to swing through a complete pendulum cycle. The distance between the first and second stopping positions of the trolley corresponds with the horizontal component of movement of the container during the first quarter of the pendulum swinging cycle. At the second stopping position of the trolley, it is directly above the container, and the suspension ropes extend in a vertical direction. At the end of the first quarter, the container stops and the trolley is also stopped, because it has caught up with the container. In the normal swinging movement of a pendulum, the bob stops at the end of the first quarter of the cycle, and then swings back in a reverse direction, due to the force of gravity on the bob. However, the container does not swing back, but rather remains motionless, because the container is already at its lowest possible point relative to the trolley, which forms the pivot of the pendulum. Consequently, the container does not have any available gravitational or positional energy to cause reverse swinging movement. Moreover, the container does not have any kinetic energy, because the container has come to a stop position. The container remains motionless, because the container does not have any kinetic energy or positional energy to cause it to move.

The method of the present invention is also applicable to the accurate and quick placement of a stack of the freight containers on the deck of the container ship. When all of the cells or compartments of an area of the container ship have been filled with freight containers, additional containers are often stacked on the deck and on each other and are securely fastened to the ship to increase the load hauling capacity of the ship for ocean transport. The method of the present invention makes it possible to transport each container to the desired location on the deck and to bring the container to a complete stop, without any residual swinging movement.

Container cranes are also employed for unloading container ships. The container crane is operated so as to hoist each container out of its cell on the ship and to transport the container to a delivery location, which may be on a waiting semi-trailer truck or railroad car. The method of the present invention makes it possible to operate the trolley to transport the container horizontally to a position directly over the desired delivery location, where the container is brought to a complete stop without any residual swinging movement. In accordance with the present invention, the trolley is stopped not once but twice in quick succession. The second stopping position is directly over the desired delivery location. The first stopping position is spaced short of the second stopping position by a distance corresponding to the horizontal distance which the container will travel during the first quarter of a complete cycle of pendulum swinging movement. The stopping of the trolley in the first position initiates the first quarter of pendulum swinging movement, but the trolley is moved between the first and second positions at a controlled rate so that the trolley just catches up with the container when the trolley reaches the second position. The elapsed time of the movement of the trolley between the first and second positions corresponds with the time duration of the first quarter of the pendulum swinging movement of the container. The method of the present invention has the effect of limiting the swinging movement of the container to the first quarter of its pendulum swinging movement, so that the container is stopped motionless, directly over the desired delivery location. The container is then quickly lowered until it comes to rest in the delivery location, on a truck, railroad car or the like.

The time duration of the first quarter of the pendulum swinging movement can be determined empirically by a series of testing operations. The same is true of the horizontal distance traveled by the container during the first quarter of the pendulum swinging movement. The time duration is primarily a function of the length of the pendulum. The time duration increases when the length is increased. To a much lesser extent, the time duration of the first quarter is a function of the weight of the load, comprising the container and the spreader bar or other grasping device for connecting the container to the hoisting rope system whereby the container is suspended from the trolley. The period or time duration of the pendulum cycle would be entirely independent of the weight of the load or bob, were it not for the effect of air friction and other forms of frictional resistance to the swinging movement of the pendulum. The nearly independent relationship between the weight of the bob and the time duration of the pendulum cycle arises from the fact that the acceleration of a falling body due to gravity is a constant, regardless of the weight or mass of the body. Since ancient times, people have known that a heavy or massive body and a lighter body fall at the same rate due to gravity, except for the effect of air resistance. In a container crane, the swinging movement of the container is resisted by air friction and also by friction arising in the wire rope suspension system. The frictional resistance to the swinging movement of the container is less important for a heavy container than it is for a light container. Consequently, the time duration or period of the pendulum swinging cycle is affected to some extent by the weight of the container. The horizontal distance traveled by the container during the first quarter of its pendulum swing is also a function of the weight of the container, to some extent. The length of the pendulum is easily adjusted and controlled and is usually substantially the same for all of the containers to be loaded on any particular container ship, or to be unloaded therefrom. The weight of all of the containers tends to be approximately the same, particularly when they are loaded with the same or similar merchandise. The relationship between the first quarter time duration and the weight of the container can be determined empirically by a series of testing operations with loads having different weights.

The method of the present invention can be carried out manually by an operator who manipulates the controls of the container crane. Ordinarily the controls of the crane give the operator full control over the translation of the trolley in both directions, as well as the hoisting movement of the container in both directions. Typically, the operator can also control the movement of the entire crane along rails on the dock or wharf where the crane is located.

However, the method of the present invention is most advantageously implemented by the apparatus of this invention whereby the various operations of the crane can be controlled automatically to a great extent. Preferably, the trolley is provided with a reversible, variable speed drive motor, as well as an electrically operable clutch and brake. Trolley power control means are also provided for controlling the supply of power to the motor, the clutch and the brake.

Similarly, the hoist means for hoisting the load are provided with a reversible electrical hoist motor, as well as an electrically controllable clutch and brake for precisely controlling the raising and lowering of the container. Hoist power control means are preferably provided for controlling the supply of electrical power to the motor, the clutch and the brake.

A general purpose or special purpose computer is preferably employed to supply control signals to the trolley power control means and the hoist power control means.

The hoist control means preferably comprise an encoder for supplying encoded electrical signals to the computer to indicate the effective pendulum length of the pendulum system comprising the pivot means supplied by the trolley, the suspension means supplied by the hoisting rope system and the bob comprising the container and the spreader bar or other grasping device.

Similarly, the trolley drive system preferably comprises a trolley position encoder for supplying encoded signals to the computer to indicate the position of the trolley and also preferably the direction in which the trolley is being driven.

The crane also preferably comprises a container weight sensor or encoder for supplying encoded signals to the computer to indicate the weight of the container or other load that is carried by the hoist means.

The spreader bar or other grasping device is preferably electrically operable or controllable for causing the spreader bar to grasp and release the container. Spreader bar power control means are preferably connected between the spreader bar and the computer, so that the spreader bar is controllable by signals from the computer.

To provide for manual control of the crane, the computer is provided with manually operable input means including trolley drive input control means, hoist input control means, and spreader bar control means. All the control means may be provided by a standard computer keyboard or one or more special keyboards or other controls.

The computer is provided with a software program or some other program so that the computer can determine the first and second stopping positions of the trolley for each of the cells of the container ship. The programming also enables the computer to determine the time duration of the first quarter of the pendulum swinging cycle as well as the horizontal distance which is traveled by the container during the first quarter of the pendulum cycle. By utilizing this information, the computer is able to establish the distance between the first and second stopping positions of the trolley. The programming also enables the computer to determine the starting and stopping times of the trolley and the speed at which the trolley is driven as it is moved between the first and second stopping positions, so that the trolley just catches up with the forwardly swinging container as both the trolley and the container arrive simultaneously at the second position, directly over the cell or other place where the container is to be loaded.

The program of the computer also enables the computer to cause the hoist motor to lower the container into the selected cell in the container ship, when the trolley stops in the second position.

When the downward movement of the container is stopped by the engagement of the container with the bottom of the cell or another container previously loaded into the cell, the computer is enabled by its program to release the spreader bar and to cause the hoist motor to lift the spreader bar to a previously programmed elevation. The computer is then enabled by its program to cause the trolley drive motor to move the trolley to a position over the next container to be loaded into the container ship, whereupon the computer can be enabled by its program to lower the spreader bar into engagement with the next container so that it can be grasped and hoisted.

The operator is able to interrupt the automatic series of functions carried out under the control of the computer, so that the operator can assume manual control of the trolley drive means, the hoist drive means and the spreader bar drive.

While the present invention has been described primarily in connection with the loading of freight containers into container ships, the invention is also applicable to the unloading of full or empty containers from container ships or other vehicles, such as railroad cars and trucks, as well as from storage yards and other places where full or empty containers are placed or stored. During unloading operations, the present invention makes it possible to stop the spreader bar grasping device or any other grasping device directly over the container which is to be unloaded, while limiting the swinging movement of the spreader bar to the first quarter cycle of the pendulum swinging movement thereof. When the spreader bar is carrying an empty container, the present invention makes it possible to stop the container directly over the location where it is to be placed, while limiting the swinging movement of the container to an absolute minimum, corresponding with the first quarter cycle of the pendulum swinging movement of the container.

In all cases, the trolley of the crane is stopped in a first position and then is quickly moved to a second position, directly over the desired final location. As the trolley arrives at the second position, it catches up with the container or spreader bar, so that it is stopped motionless above the desired location. The container or spreader bar is then lowered to perform the desired loading or unloading operation. The present invention is also applicable to the loading and unloading of other types of loads adapted to be carried by other load carrying devices.

While the present invention is particularly well adapted for controlling a container crane, the invention can also be applied to the control of a crane which is adapted to hoist and transport other loads, such as loose granular bulk materials which may be picked up and carried by a power operated grab bucket.

The present invention is particularly applicable to gantry-type container cranes, but is also applicable to many other types of cranes, particularly trolley cranes, such as overhead trolley cranes which are frequently installed in industrial and warehouse buildings and also in outdoor storage yards.

DETAILED DESCRIPTION OF ILLUSTRATIVE EMBODIMENTS OF THE INVENTION

Figure 1:
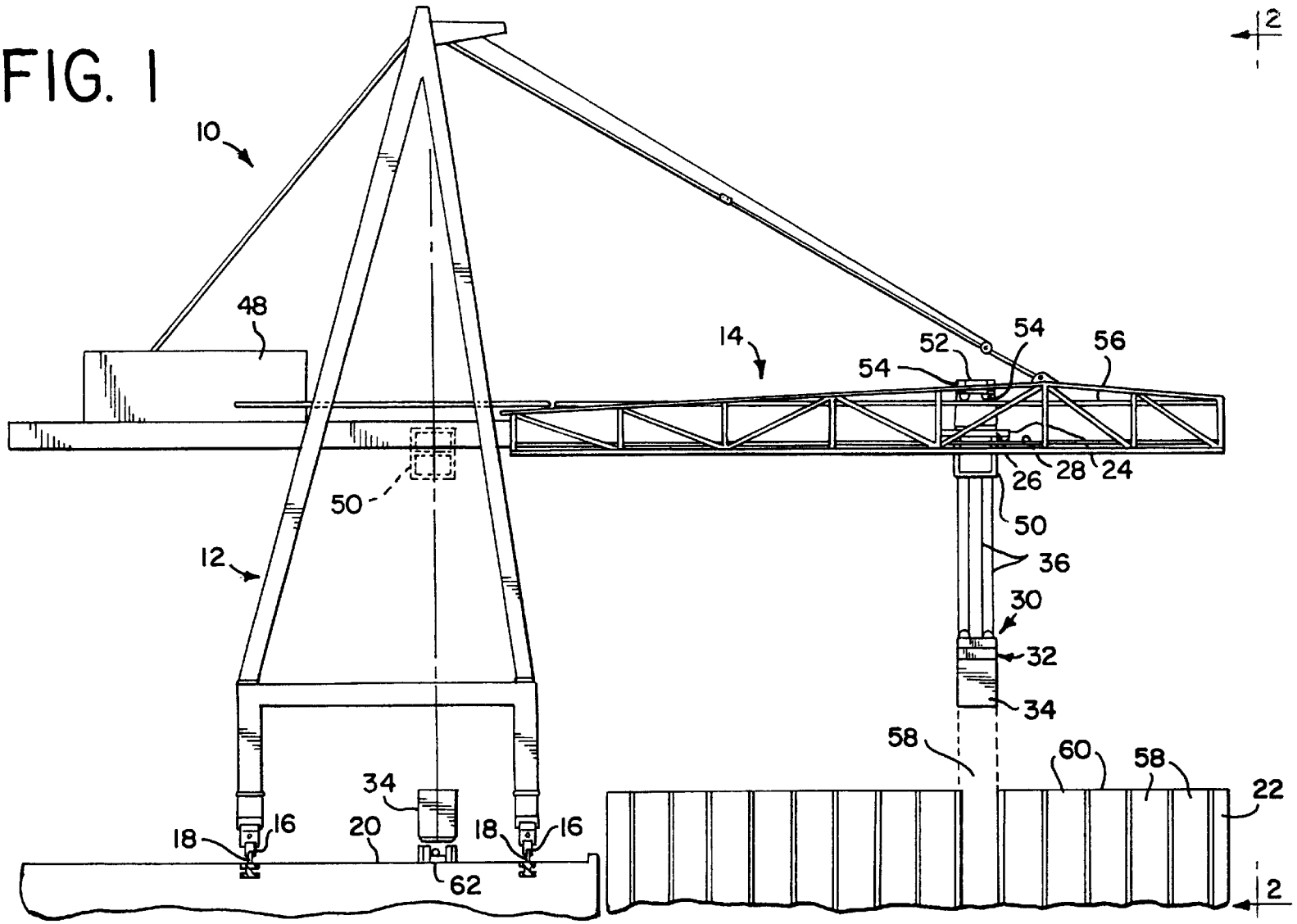
FIG. 1 is a side elevational view of a container crane equipped with a crane controlling and operating system to be described as an illustrative and presently preferred embodiment of the present invention.

FIG. 1 illustrates a typical container crane 10 to which the method and apparatus of the present invention are applied. The crane 10 comprises a generally vertical tower 12 on which a substantially horizontal boom 14 is mounted. The tower 12 is fitted with flanged wheels 16 supported by a pair of parallel rails 18 on a wharf or dock 20, alongside which a container ship 22 (FIG. 3) may be docked.

Figure 3:
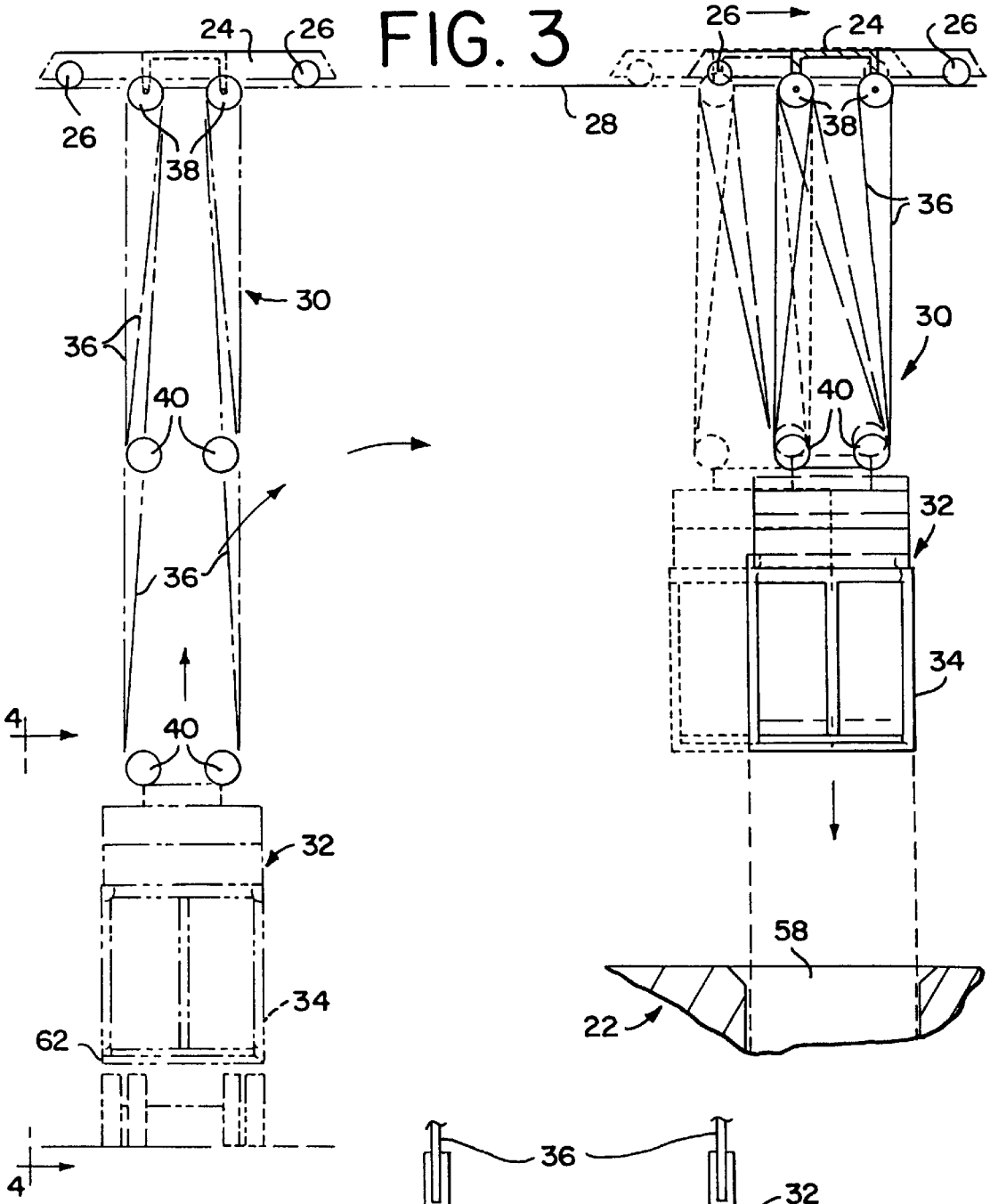
FIG. 3 is a fragmentary enlarged diagrammatic elevational view showing three successive positions of the translatable trolley on the container crane, and also showing a freight container suspended from the trolley by a wire rope hoisting system and a spreader bar device for releasably grasping the container.
Figure 4:
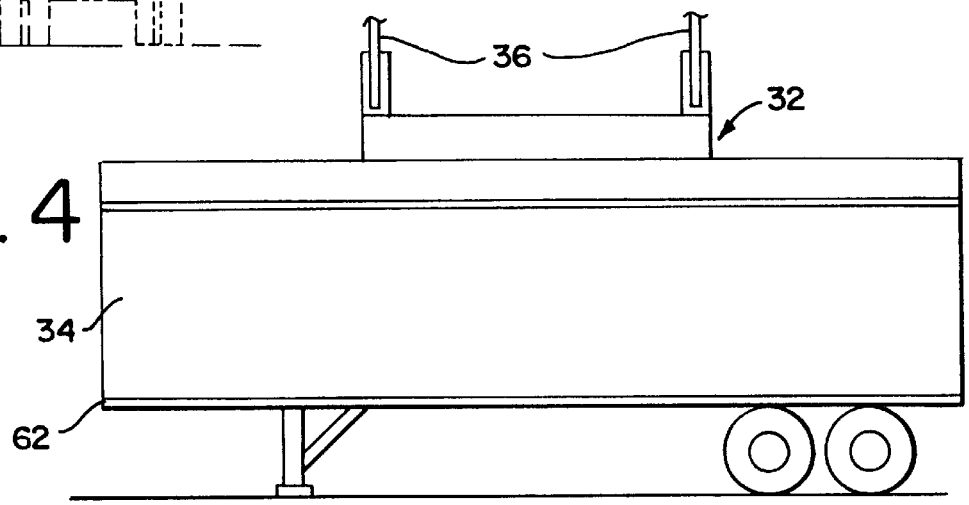
FIG. 4 is a fragmentary side elevational view of the container and the spreader bar, taken generally as indicated by the line 4—4 in FIG. 3.

As shown to best advantage in FIGS. 3 and 4, the horizontal boom 14 is provided with a translatable trolley 24 having rotatable wheels or rollers 26 movable along track means comprising one or more horizontal tracks or rails 28 mounted on the boom 14 and extending along virtually the entire length thereof.

The trolley 24 is fitted with hoist means 30 for supporting and hosting a spreader bar device 32 whereby a standard freight container 34 can be grasped and hoisted.

The hoist means 30 comprise a system of hoisting wire ropes 36 whereby the spreader bar device 32 is suspended from the translatable trolley 24. The hoisting wire ropes 36 are trained around a system of pulleys 38 on the trolley 24 and pulleys 40 on the spreader bar device 32. One or more of the wire ropes 36 extend from the pulleys 38 on the trolley 24 in a generally horizontal direction to a machinery house 48 mounted on the boom 14. The machinery house 48 contains hoisting machinery (not shown) for reeling in and paying out the hoisting wire ropes 36 whereby the spreader bar device 32 can be raised and lowered under the control of a human operator who may have a work station in the machinery house 48 or preferably in a cab or car 50 adapted to travel along the boom 14 under the control of the operator.

Figure 2:
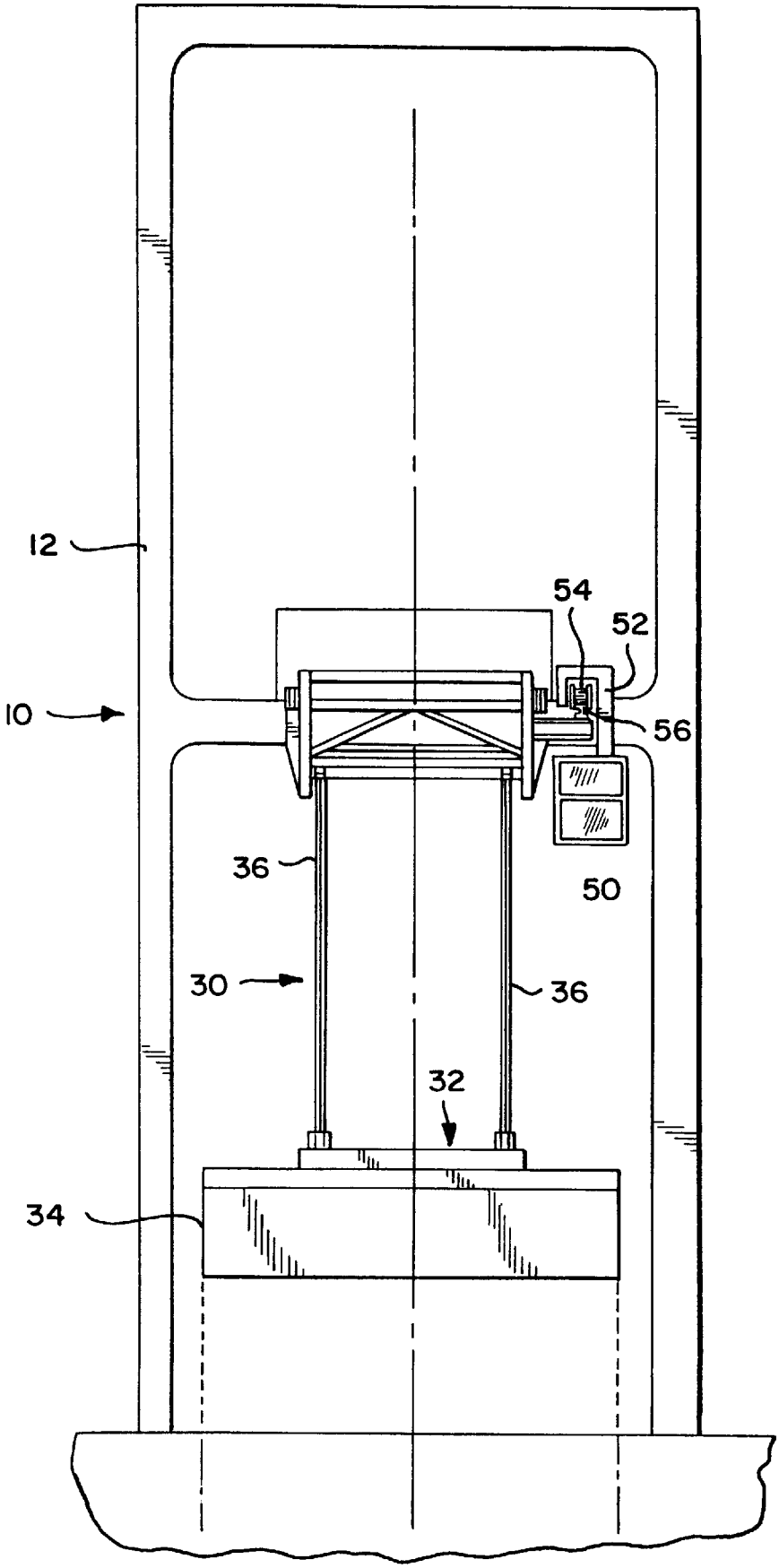
FIG. 2 is an end elevational view of the crane, taken as indicated by the line 2—2 in FIG. 1.

As shown in FIG. 2, the operator's cab 50 has a separate suspension arm or trolley 52 fitted with rollers or wheels 54 adapted to roll along a separate horizontal rail 56 on the boom 14. The cab 50 is provided with a drive system (not shown) operated by machinery in the machinery house 48 so that the operator can cause the cab 50 to travel along the rail 56, as desired, whereby the operator can position the cab 50 generally as shown in full lines in FIG. 1, so as to afford the best possible view of the container 34 and the spreader bar device 32, or of any location on the ship 22 or on the wharf 20 or on the shore or a barge or other vehicle where the container 34 is to be loaded or placed, or any location from which the container is to be unloaded or removed. The cab 50 can be moved independently along the rail 56 to any desired position, such as the position shown in broken lines in FIG. 1, above a semi-trailer 62 on the wharf 20.

The machinery house 48 also includes driving machinery for moving the trolley 24 along the boom 14 in either direction under the control of the operator, whereby the trolley 24 can be moved to any desired position along the boom 14. The driving machinery may be connected to the trolley 24 by a wire rope system or any other known or suitable means.

The container crane 10 may be employed for loading or unloading freight containers 32 into or out of the container ship 22. As shown in FIG. 1, the ship 22 is divided into a large number of cells or compartments 58. A considerable number of the freight containers 34 can be stacked in each of the cells 38. Removable hatch covers 60 are provided to close the upper ends of the cells 58, as desired, for weather protection and also to support additional containers on top of the covers 60 as a deck load which is securely lashed or otherwise fastened to the deck.

The loaded freight containers 34 are brought to the wharf or dock 20 by flat bed semi-trailer trucks or railroad cars. FIGS. 1 and 4 show a semi-trailer 62 on which one of the containers 34 has been brought to the wharf 20 for unloading by the crane 10, which is then employed to load the container 34 into one of the cells or compartments 58 in the container ship 22 or on to the ship 22 as a deck load.

In general, the crane 10 is operated by propelling the trolley 24 along the boom 14 so that the spreader bar grasping device 32 is positioned over the freight container 34 on the semi-trailer 62. The hoist means 30 are then operated so as to lower the spreader bar 32 until it can be operated so as to grasp the container 34. The hoist means 30 are then employed to lift the container 34 to an elevation such that the container 34 will clear any obstacles on the dock 20 and the ship 22. The driving means for the trolley 24 are then operated so as to translate the trolley 24 to a position over the desired cell or compartment 58 in the container ship 22, or over a deck loading location on the ship. The hoist means 30 are then operated so as to lower the container 34 into the cell 58 until it engages the bottom of the cell or the top of another container which has previously been loaded into the cell. The spreader bar device 32 is than released from the freight container 34, whereupon the hoist means 30 are employed to lift the spreader bar device 32 out of the cell 58 and upwardly to a clearance elevation. The trolley drive means 26 are then operated to translate the trolley 24 inwardly along the boom 14 until the spreader bar 32 is located over the wharf 20, ready to be lowered into engagement with the next container 34 which is to be loaded into the ship 22.

In the prior operation of container cranes and other similar cranes for hoisting and transporting a container or some other load, a problem has been encountered in quickly and accurately positioning the container 34 in a stationary position over the cell or compartment 58, so that the container 34 can be lowered into the cell 58, with a minimum of contact with the walls of the cell. This problem arises from the fact that a pendulum is effectively formed by the combination of the suspended load, comprising the container 34 and the spreader bar 32; the suspension means comprising the hoisting ropes 36; and the pivotal support comprising the translatable trolley 24. The bob of the pendulum is formed by the heavy freight container 34 and the associated spreader bar 32. When the trolley 24 is moved along the boom 14 so as too transport the spreader bar 32 and the container 34 in a horizontal direction, the starting and stopping of the trolley 24 causes repetitive or oscillatory swinging movement of the container 34 and the suspending ropes 36. The repetitive pendulum-type swinging movement makes it difficult to stop the container in a stationary position at any desired location, such as a location directly above the cell 58 or any other place where the container 34 is to be placed. The pendulum swinging movement of the container causes a loss or waste of valuable time in accurately positioning the containers so that they can be lowered into the various cells 58.

Figure 7:
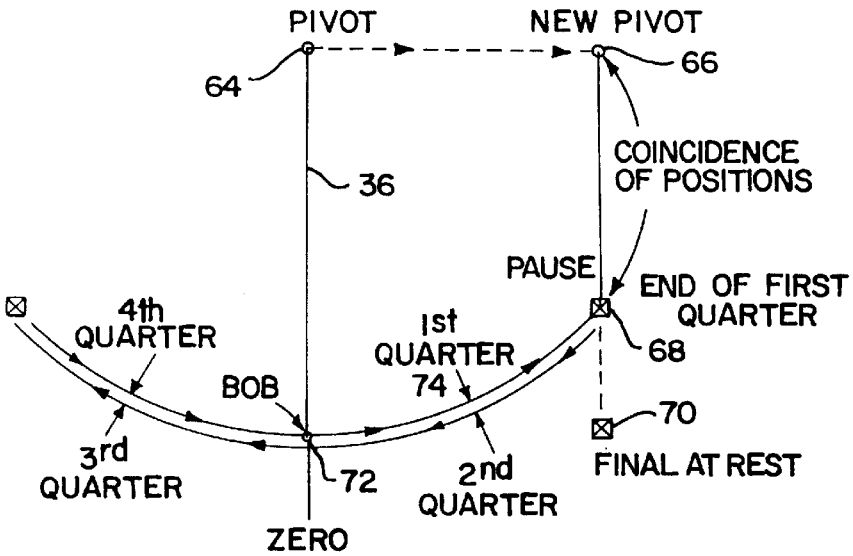
FIG. 7 is a diagrammatic elevational view illustrating the suspension rope system and the container as a pendulum system, in order to illustrate the mode of operation of the control system.

FIG. 7 is a pendulum diagram which is helpful in explaining the method of the present invention, whereby the deleterious effect of repetitive pendulum swinging motion is eliminated. In accordance with the method of the present invention, the freight container 34 is brought to a complete, stationary stop, directly over the desired cell 58 where the container is to be placed, by stopping the translatable trolley 24 not once, but twice, in a rather rapid sequence. As the trolley 24 travels in an outward direction along the boom 14, the trolley is stopped in a first pivot position 64, shown in FIG. 7. The trolley 24 is again started outwardly and then is completely stopped in a second pivot position 66, directly over the desired cell 58 or any other place where the container or other load is to be placed. The trolley 24 provides the pivot for the pendulum, which also comprises the suspension ropes 36 and the container 34 or other load, constituting the bob of the pendulum. When the trolley 24 is stopped at the first pivot point 64, the momentum of the container 34 or other load causes it to swing outwardly from a first or zero position 67 in the direction in which the trolley 24 was moving. If the trolley 24 were to remain at the first pivot position 64, the container 34, acting as the bob of the pendulum, would swing outwardly or forwardly along the first quarter of its pendulum swing and would come to a complete but momentary stop or pause at a first pause position 68. The location of the first pivot position 64 is selected so that the first pause position 68 is substantially directly over the desired final rest position 70 of the container 34, located directly over the desired cell 58 or any other place where the container is to be placed.

In accordance with the present invention, however, the trolley 24 is stopped only briefly at the first pivot position 64. The trolley 24 is then started outward again and moved outwardly or forwardly with a speed and timing such that the trolley 24 catches up with the container 34 and is stopped in the second pivot position 66, simultaneously with the arrival of the container 34 at its final rest position 70. In the final rest position 70, the kinetic energy of the previously moving container 34 has been expended, and the relative gravitational or positional energy of the container 34 has also expended, because the container 34 is at the final rest position 70 which is at the same elevation as the first or zero position 72 occupied by the container 34 when the trolley 24 is stopped at the first pivot position 64. As the container 34 swings between the first position 72 and the final rest position 70, the container 34 moves upwardly at first and then settles downwardly as the trolley 24 catches up with the container 34.

The distance traveled by the trolley 24 between its first and second stopping positions 64 and 66 corresponds rather closely to the horizontal distance that the container 34 would have traveled along the first quarter of its pendulum swing between the first or zero position 72 and the first pause position 68. The distance traveled by the trolley 24 between its first and second positions 64 and 66 is pre-selected to correspond exactly with the horizontal distance traversed by the container 34 as it swings between its first or zero position 72 and its final rest position 70, from which the container 34 is lowered directly into the desired cell 58 by operating the hoist means 30.

In the method of the present invention, the timing of the first and second stops of the trolley 24 at the first and second pivot positions 64 and 66 is controlled so that the time interval between the first and second stops corresponds with the first quarter 74 of the swinging cycle or period of the pendulum formed by the freight container 34 and the spreader bar 32, constituting the bob, the wire ropes 36, constituting the suspension means, and the trolley 24, constituting the pivot means of the pendulum. The period or cycle time interval of the pendulum is largely a function of the length of the pendulum, and to a much lesser extent is a function of the combined weight of the container 34 and the spreader bar 32.

Figure 8:
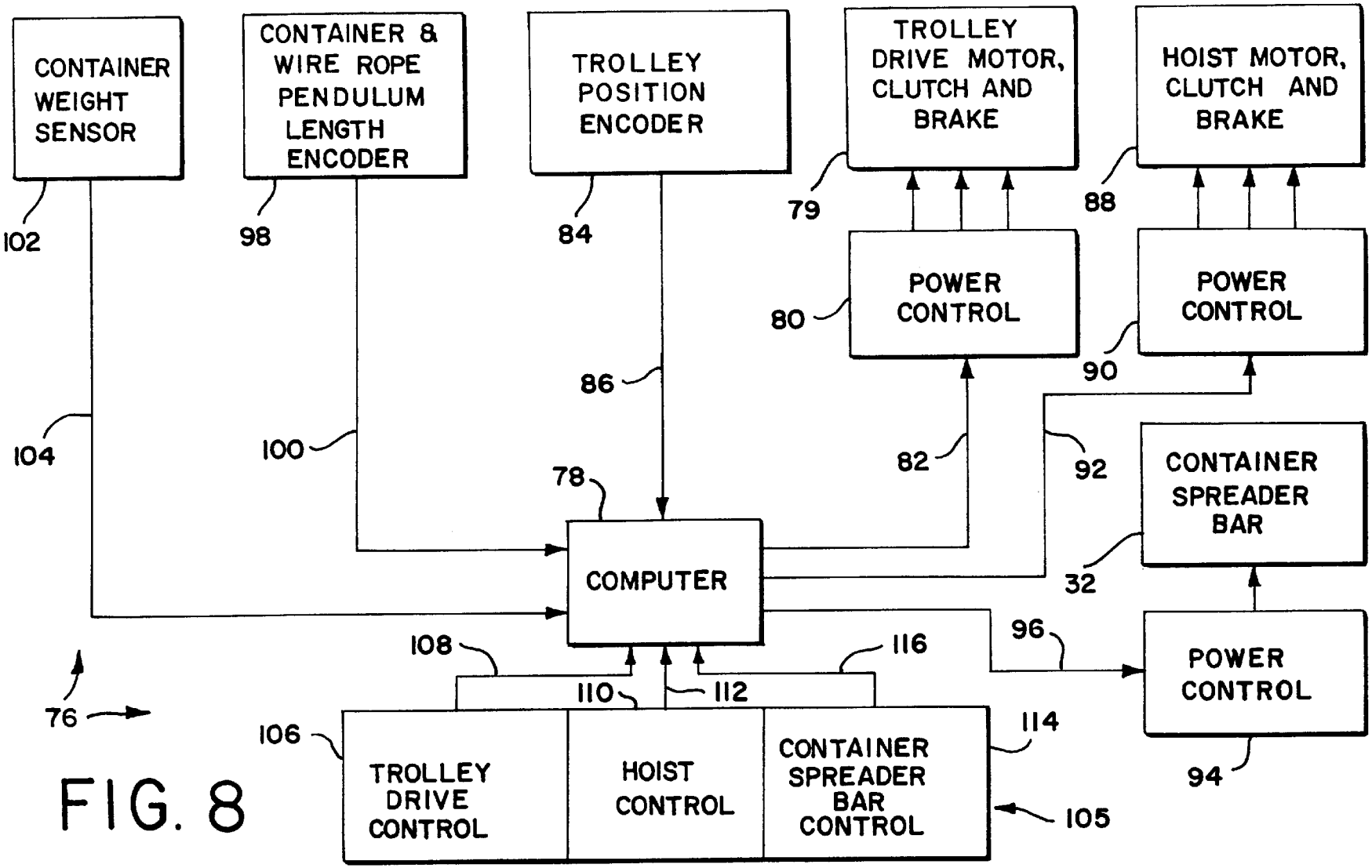
FIG. 8 is a block diagram illustrating the container crane controlling and operating system of the present invention.

FIG. 8 is a block diagram of a control and operating system or means 76 for carrying out the method of the present invention. The control system 76 includes a computer 78 for coordinating the operation of the other components of the control system 76. The trolley 24 is driven, operated and controlled by trolley control and operating means 79 represented by a block entitled TROLLEY DRIVE MOTOR, CLUTCH AND BRAKE in FIG. 8, whereby the trolley is translated by a reversible electric motor connected to the trolley 24 by a drive system comprising an electrically operable clutch and brake. Electrical power is selectively supplied to the trolley control and operating means 79 by power control means 80 represented by a block labeled POWER CONTROL. The computer 78 supplies control signals to the power control means 80 by way of a control connection 82. The control system 76 also includes a TROLLEY POSITION ENCODER 84 which produces electrical signals which represent the position of the trolley 24. Such signals are transmitted to the computer 78 along a signal connection 86.

The control system 76 also includes hoisting control and drive means 88 represented by a block entitled HOIST MOTOR, CLUTCH AND BRAKE. Thus, the hoist means 30 for raising and lowering the spreader bar grasping device 32 and the freight container or other load 36 comprise a reversible electrical motor connected to a conventional hoisting system by an electrically operable clutch and brake. Electrical power is selectively supplied to the HOIST MOTOR, CLUTCH AND BRAKE by power control means represented by a block 90 labeled POWER CONTROL, supplied with control signals from the computer 78 by a control connection 92.

The spreader bar grasping device 32 is electrically operable and is represented by a block entitled CONTAINER SPREADER BAR. Electrical power is selectively supplied to the spreader bar 32 by power control means 94 represented by a block labeled POWER CONTROL. The power control means 94 are supplied with control signals from the computer 78 by way of a control connection 96.

The control system or means 76 also comprise a CONTAINER & WIRE ROPE PENDULUM LENGTH ENCODER 98 for producing encoded electrical signals which indicate the length of the pendulum comprising the container 34, the spreader bar 32, the suspension wire ropes 36 and the trolley 24, which provides the pivotal support for the pendulum. The encoded signals are supplied to the computer 78 by a signal connection 100.

The control system 76 also comprises a CONTAINER WEIGHT SENSOR 102 which produces encoded signals indicating the combined weight of the container 34 and the spreader bar 32. Such signals are supplied to the computer 78 by another signal connection 104.

The control system 76 also comprises input means 105 whereby the operator can supply input signals or commands to the computer 78 for exercising manual control over the trolley 24, the hoist means 30 and the spreader bar 22. Thus, the control system 76 comprises trolley drive control means 106, as represented by a block entitled TROLLEY DRIVE CONTROL, connected to the computer 78 by a signal connection 108, whereby the operator can control the direction of movement of the trolley 24 and can also start and stop the trolley 24 under manual control, although, in most instances, the starting and stopping of the trolley 24 is controlled by the computer 78 and its software or other program, whereby the starting and stopping of the trolley 24 are automatically controlled in accordance with the method of the present invention.

The control system 76 also comprises manually operable hoist control means 110, as represented by a block entitled HOIST CONTROL, having another signal connection 112 to the computer 78, whereby the operator can manually control the stopping and starting and the direction of operation of the HOIST MOTOR, CLUTCH AND BRAKE 88, although in many instances these functions are automatically controlled by the computer 78 and its software or other program, in accordance with the method of the present invention.

The control system 76 also comprises a CONTAINER SPREADER BAR CONTROL 114, having a signal connection 116 to the computer 78, whereby the operator can manually control the grasping and releasing functions of the spreader bar grasping device 32, for manually controlling the grasping and releasing functions, before the beginning of a hoisting function and after the end of the function. However, in many instances, the grasping and releasing functions can be automatically controlled by the computer 78 and its software or other program, to speed up the method of the present invention and to prevent the spreader bar 32 from releasing the container 34 when the weight of the container is being carried by the hoisting ropes 36.

The computer 78 may be provided with software or some other program for inputting the computer 78 with the dimensions and other characteristics of the container ship 22, so that the computer 78 will be able to stop the trolley 24 directly over each of the cells or compartments 58 in the ship 22. The program may also input the computer 78 with information as to the above-deck locations where containers are to be stacked.

The TROLLEY DRIVE CONTROL 106, the HOIST CONTROL 110 and the CONTAINER SPREADER BAR CONTROL 114 may take the form of a standard computer keyboard, or one or more special keyboards or other devices.

The computer 78 may have software for utilizing the memory capabilities of the computer 78 to store and reuse information which is inputted manually into the computer 78 by the control devices 106, 110 and 114. For example, the standard unloading location of the containers 34 from the semi-trailer trucks 62 can be inputted manually and stored in the computer 78 for repeated usage by the computer.

In the operation of the control system 76, the computer 78 uses the pendulum length signals from the encoder 98 and the container weight signals from the weight sensor 102 to calculate the time duration of the first quarter swing of the pendulum formed by the container 34, the spreader bar 32, the hoisting ropes 36 and the trolley 24. In accordance with the method of the present invention, this information and other information in the program is used by the computer 78 to calculate the appropriate time interval and distance between the first and second stopping points 64 and 66 of the trolley so that the container will come to a complete stop, without any further swinging movement, at the final at rest position of the container 34, and directly over one of the cells 58 of the container ship 22, so that the container can immediately be lowered by the hoist means 30 into the cell 58 under the control of the computer 78, acting through the POWER CONTROL 90 and the HOIST MOTOR, CLUTCH AND BRAKE 88, until the container 34 comes to rest on the bottom of the cell 88 or on the top of another container previously loaded into the cell. The computer 78 then uses the signal from the CONTAINER WEIGHT SENSOR 102 to trigger the release of the spreader bar 32. The computer 78 then automatically activates the HOIST MOTOR, CLUTCH AND BRAKE 88 to lift the spreader bar 32 to the programmed elevation, whereupon the computer activates the TROLLEY DRIVE MOTOR, CLUTCH AND BRAKE 78 to move the trolley 24 to the standard programmed position over the location where another container 34 on another semi-trailer truck 62 has been positioned for unloading. The computer 78 then automatically activates the HOIST MOTOR, CLUTCH AND BRAKE 88 to lower the spreader bar 32 to a standard programmed elevation or until the spreader bar 32 comes into contact with the waiting container 34.

The spreader bar 32 is activated automatically or manually to grasp the next container 34, whereupon the computer 78 automatically causes the HOIST MOTOR, CLUTCH AND BRAKE 88 to lift the container 34 to the programmed elevation. The computer 78 then automatically activates the TROLLEY DRIVE MOTOR, CLUTCH AND BRAKE 78 to translate the trolley 24 outwardly along the boom 14 and to stop the trolley at the first stopping point 64, the position of which has been calculated by the computer 78 in accordance with the pendulum length signals from the PENDULUM LENGTH ENCODER 98, the container weight signals from the CONTAINER WEIGHT SENSOR 102, and other information in the computer program as to the next unloading point 66, to which the trolley 24 is translated for a distance and with a time duration corresponding to the first quarter of the pendulum swing cycle, as previously explained. This automatic or nearly automatic operating cycle can be repeated indefinitely until the container ship 22 is loaded with containers 34 to the desired extent.

Figure 6:
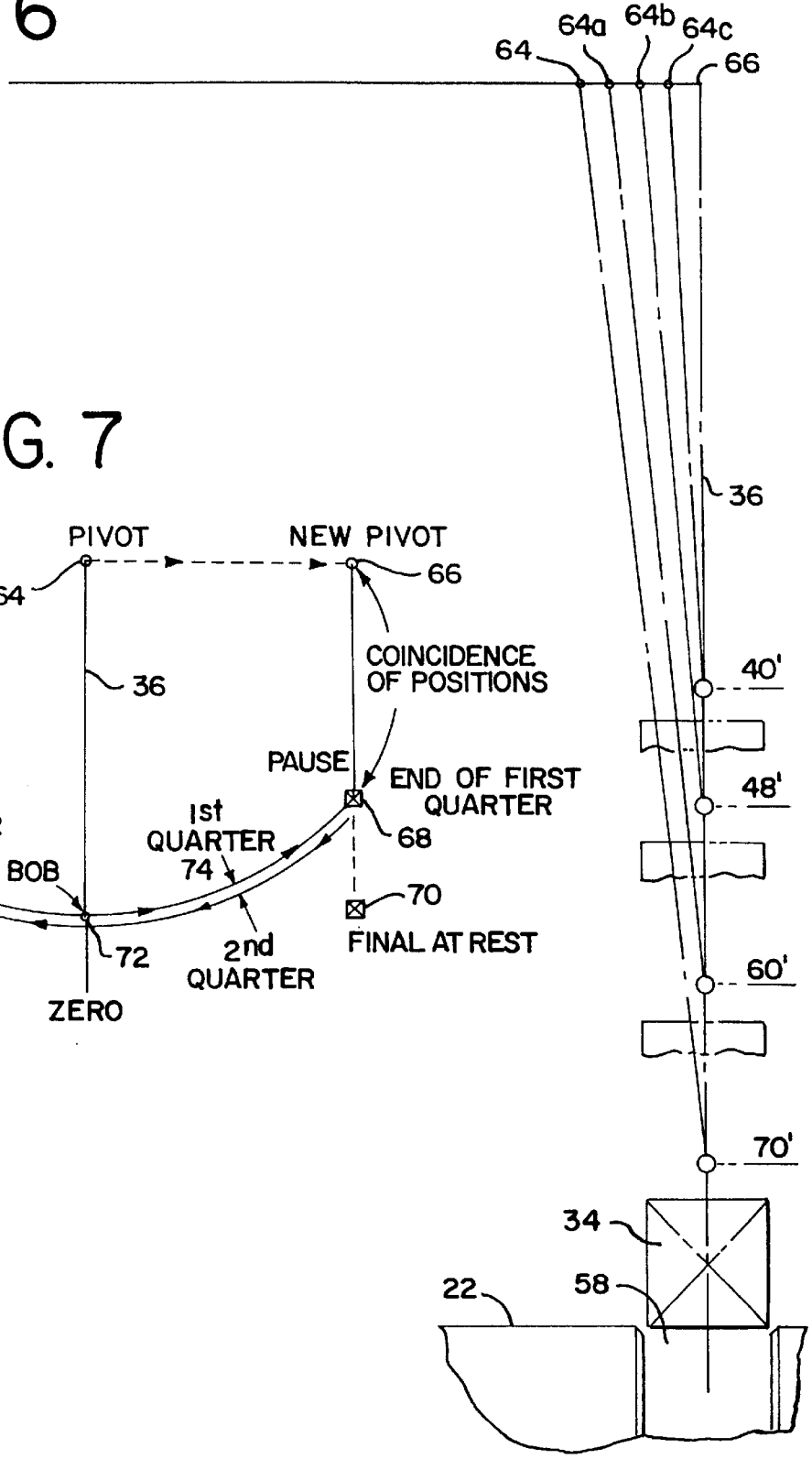
FIG. 6 is an enlarged diagrammatic elevational view corresponding to a portion of FIG. 3 and illustrating the mode of operation of the crane control system for several different lengths of the suspension rope system.

As previously indicated, the time duration or period of the pendulum swinging cycle is a function of the length of the pendulum. FIG. 6 shows the effect which is produced upon the method of the present invention by changing the length of the pendulum. The length is changed by operating the hoist means 30 for raising and lowering the spreader bar 32 and the freight container 34 suspended thereon. In FIG. 6, the first and second stopping positions 64 and 66 of the trolley 24 are shown for an effective pendulum length of 70 feet, at which the container 34 is just above the cell or compartment 58 in the container ship 22. As previously explained, the distance between the first and second stopping positions 64 and 66 of the trolley 24 corresponds with the horizontal distance that the container 34 would travel during the first quarter of the pendulum cycle. Such distance is a direct function of the effective length of the pendulum. Consequently, the distance between the first and second stopping points 64 and 66 is at a maximum when the effective pendulum length is the maximum possible amount.

If the length of the pendulum is reduced by suspending the container 32 at a higher elevation, the distance between the first and second stopping points of the trolley 24 must also be reduced to bring the container 34 to a motionless stop, directly over the cell or compartment 58. Thus, if the effective length of the pendulum is shortened from 70 to 60 feet, the first stopping point of the trolley 24 must be moved to a location 64*a,* closer to the second stopping position 66. If the effective length of the pendulum is reduced from 60 feet to 48 feet, the first stopping point of the trolley 24 must be moved to a position 64*b,* still closer to the second stopping position 66. Likewise, if the effective pendulum length is reduced from 48 to 40 feet, the first stopping point of the trolley 24 must be moved to a position 64*c,* even closer to the second stopping position 66. The computer 78 is programmed to adjust the first stopping point 64 to a distance from the second stopping point 66 which is a direct or increasing function of the effective length of the pendulum, as measured by the PENDULUM LENGTH ENCODER 98 which transmits encoded pendulum length signals along the signal connection 100 to the computer 78.

The time interval between the first and second stops 64 and 66 is also a direct or increasing function of the effective length of the pendulum. This time interval corresponds with the first quarter of the swinging cycle of the pendulum.

Figure 10:
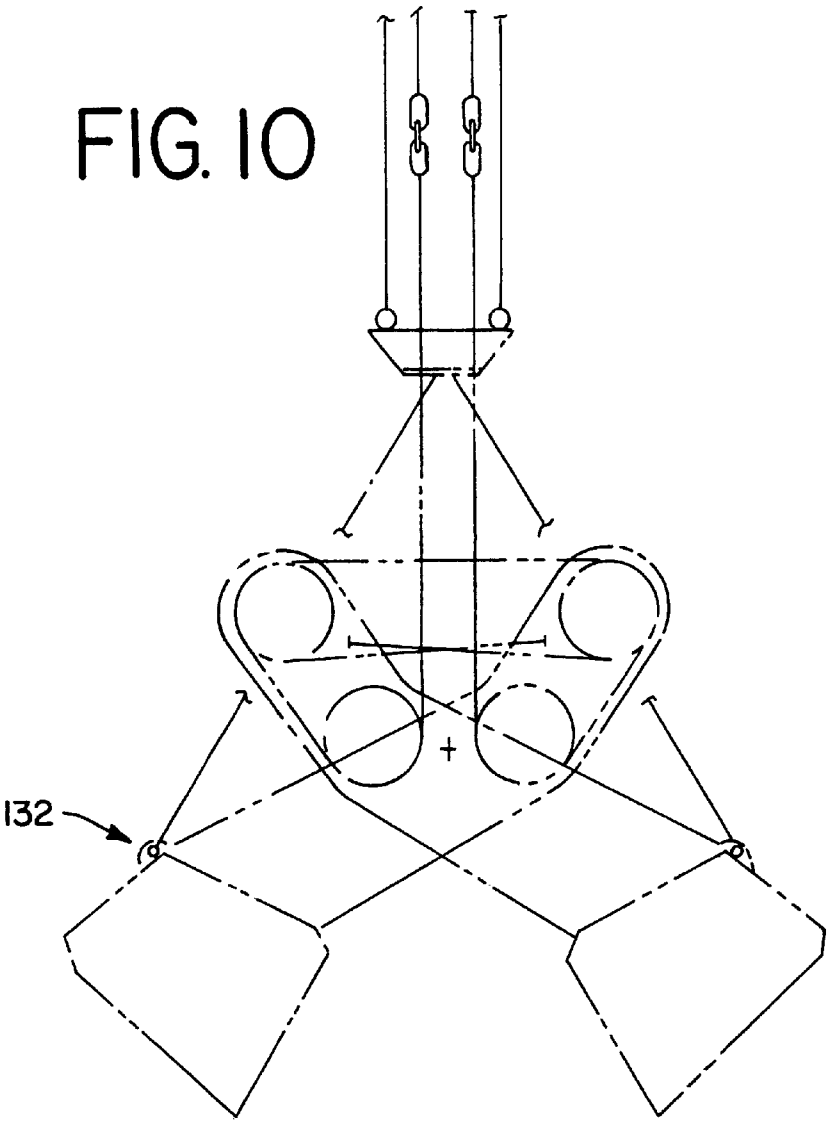
FIG. 10 is a view similar to FIG. 9, but showing the grab bucket in its open position.
Figure 9:
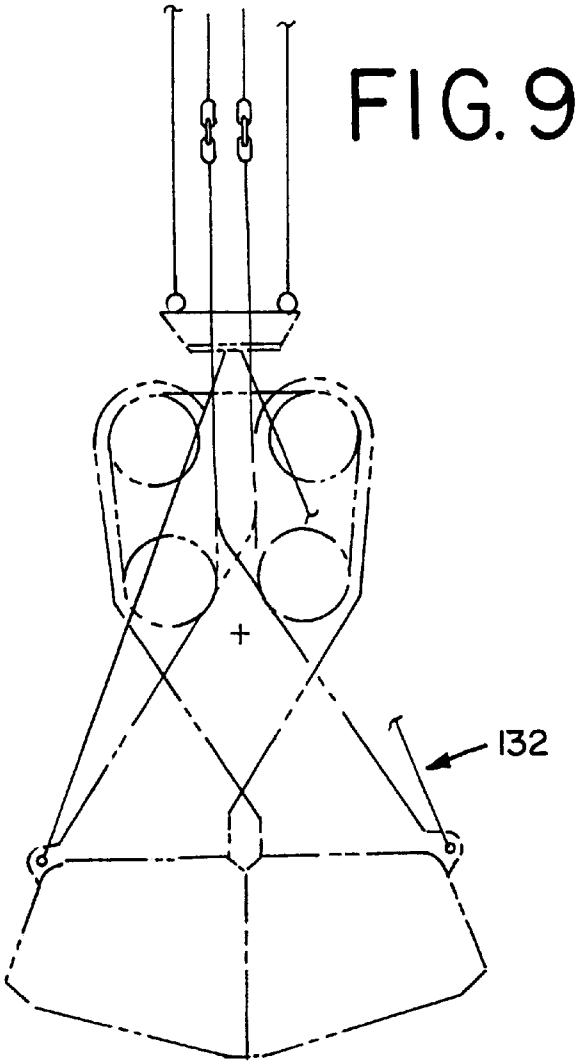
FIG. 9 is a fragmentary elevational view showing a modified embodiment of the present invention in which the spreader bar device is replaced by a grab bucket for handling loose or granular material, the bucket being shown in its closed position.

While the present invention is particularly well adapted for loading and unloading standard freight containers into or from container ships, the invention is also applicable to the handling of other types of freight, such as loose granular bulk materials. For handling such materials, the spreader bar 32 is removed and is replaced by a grab bucket 132, shown in a closed position in FIG. 9 and in an open position in FIG. 10. When the grab bucket 132 is used without the benefit of the present invention, the grab bucket 132 is subject to pendulum swinging movement when the filled and closed bucket is stopped over the desired unloading or transfer position, such as a position directly over a hopper which may be rather small, not much larger than the closed grab bucket 132. If the grab bucket is opened before the pendulum swinging movement stops, some of the bulk material discharged from the bucket 132 may miss the hopper, causing loss of the material and a messy situation requiring periodic clean-up.

By substituting the grab bucket 132 for the spreader bar grasping device 32 on the hoisting ropes 36, the present invention can be employed to bring the grab bucket 132 to a complete stop, directly over the hopper or other desired transfer or unloading position, without any pendulum swinging movement, as already explained in connection with FIGS. 1–8.

Figure 11:
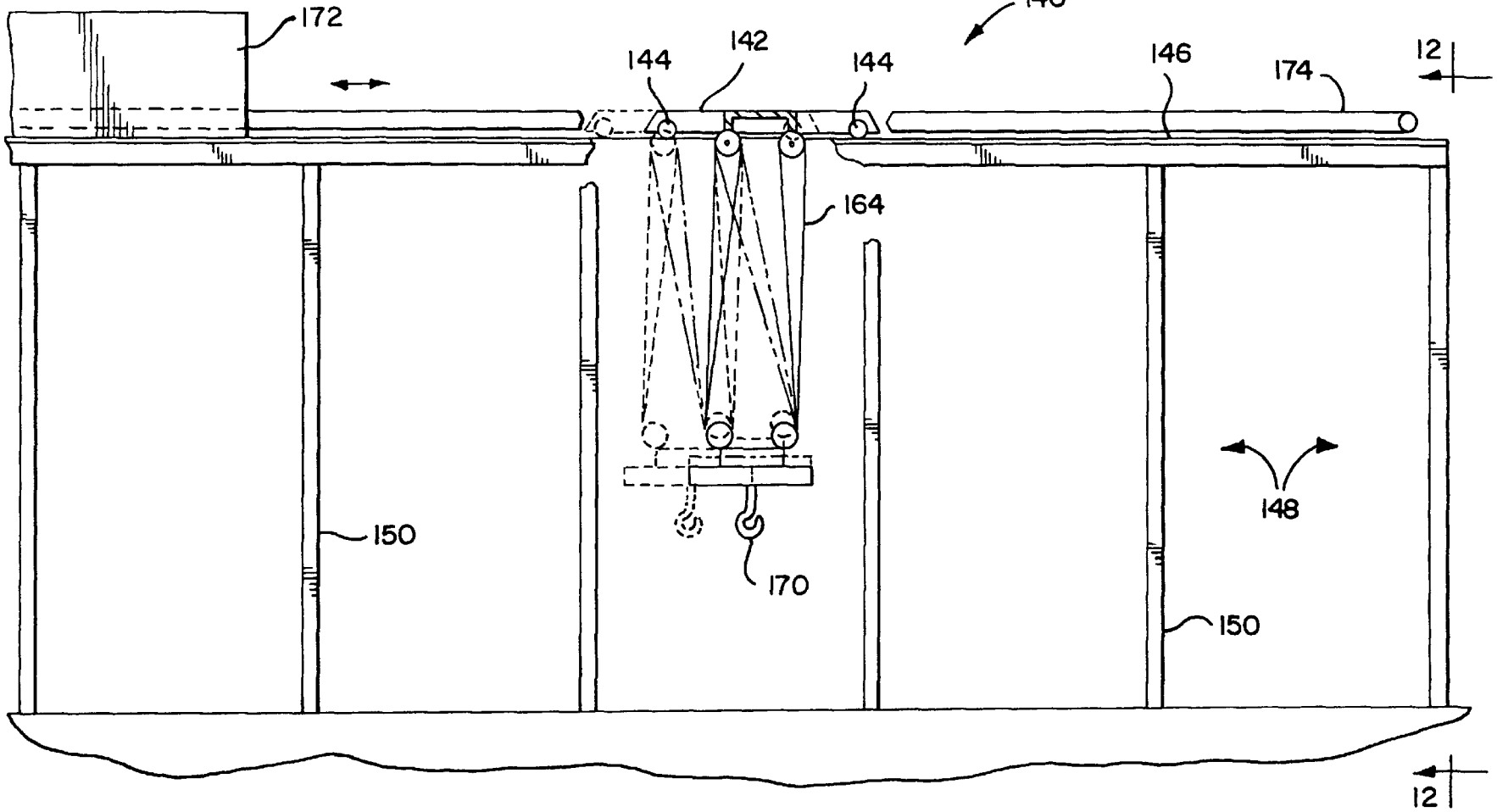
FIG. 11 is a side elevational view of a modified embodiment in which the invention is applied to an overhead traveling crane having a stationary supporting structure.
Figure 12:
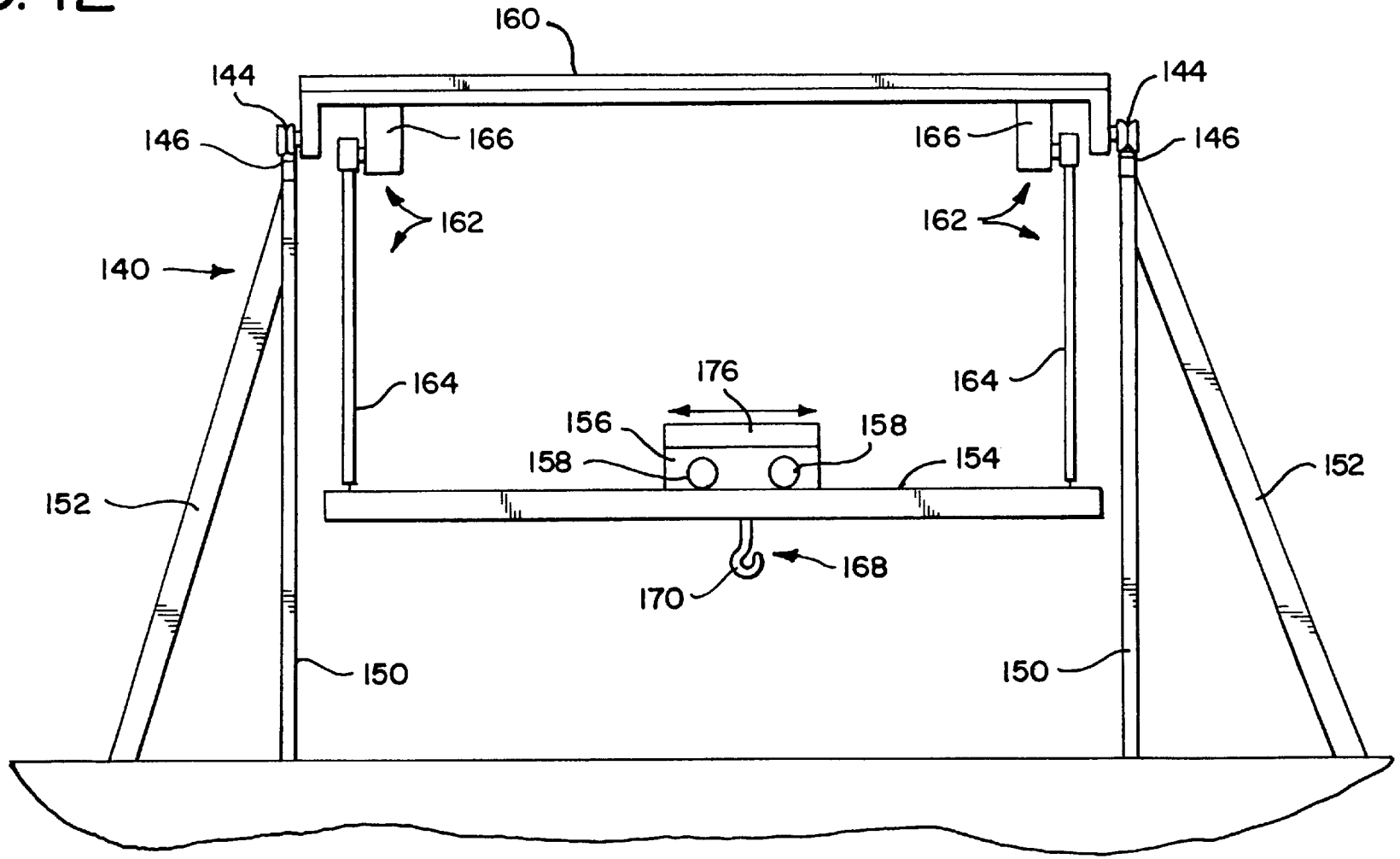
FIG. 12 is an end elevational view of the crane of FIG. 11, taken as shown by the line 12—12 in FIG. 11.
Figure 13:
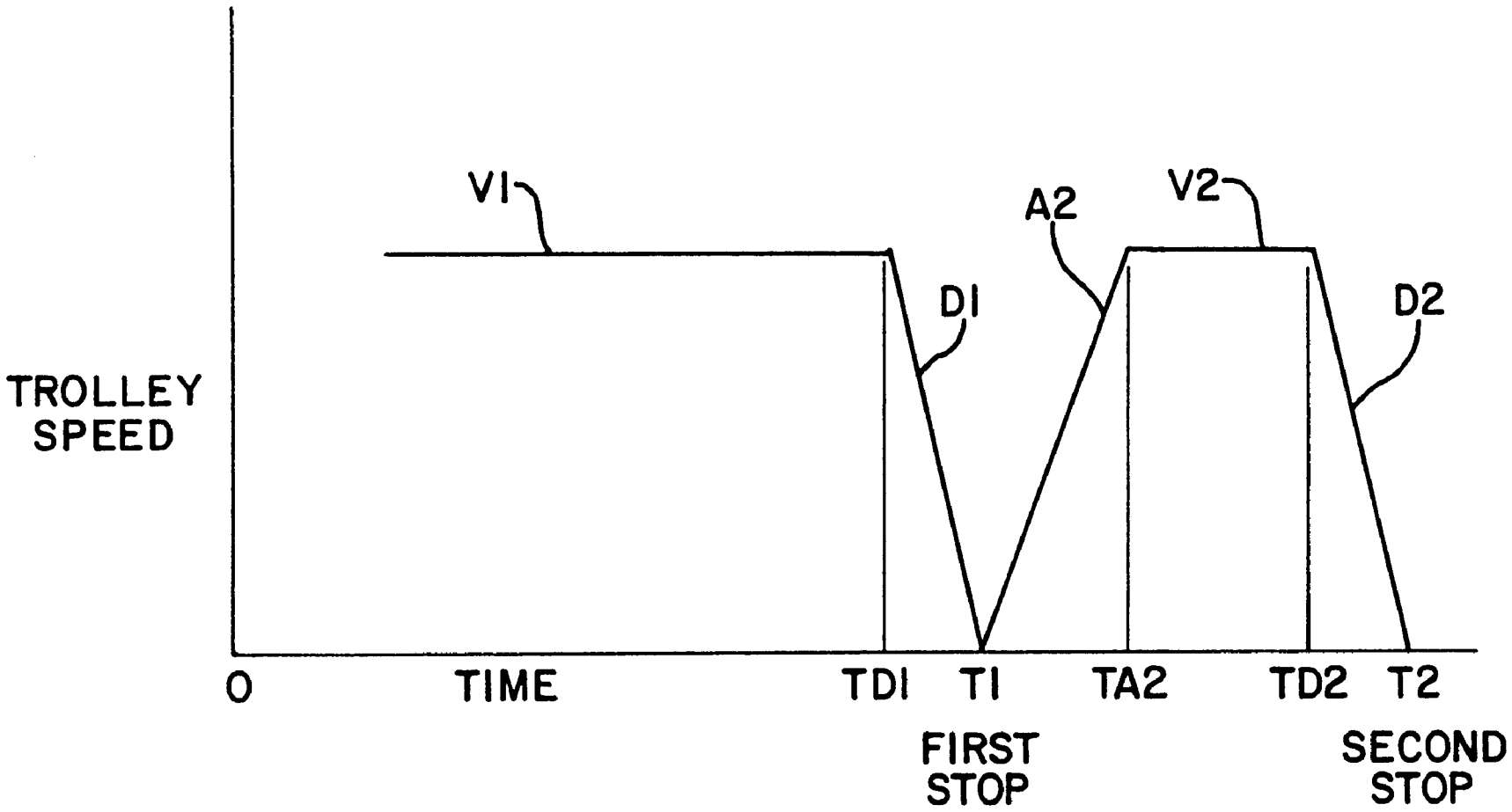
FIG. 13 is a diagram illustrating the method of the present invention.

While the present invention has been described thus far as used on a container crane 10 intended particularly for loading and unloading container ships, the invention is applicable to virtually all types of cranes. Thus, FIGS. 11 and 12 show how the present invention can be employed on an industrial type of overhead traveling crane 140 having a first elongated translatable trolley 142 having two sets of wheels or rollers 144 supported by and adapted to roll along a pair of spaced horizontal overhead rails 146 supported by a pair of side structures 148, illustrated as comprising vertical columns 150 and slanting braces 152. The side structures 148 are illustrated as free-standing, but may be incorporated into the side walls of an industrial or warehouse building. As shown, the overhead traveling crane 140 is particularly well adapted for handling freight or loads which are stored in an outdoor storage yard. When the side structures 148 are incorporated into the walls of the building, the overhead crane 140 is particularly well adapted for hoisting and carrying machinery or components thereof, work materials, freight and other loads in industrial plants and warehouses.

The first translatable trolley 142 comprises a transverse or cross rail 154 along which a second or transverse trolley 156 is translatable. The second trolley 156 has wheels or rollers 158 supported by and adapted to roll along the cross rail 154.

The first trolley 142 also comprises a rigid horizontal structure or cross bar 160 on which the wheels or rollers 146 are rotatably mounted whereby the cross bar 160 can travel along the overhead rails 146.

A pair of hoisting means 162 are provided between the transverse structure 160 and the cross rail 154. Each of the hoisting means 162 comprises hoisting wire ropes 164 and hoisting machines 166 which preferably are electrically operable. As shown in FIG. 12, the hoisting machines 166 are mounted on the first trolley 142 near the opposite ends thereof. The hoisting ropes 164 are strung between the hoisting machines 166 and the opposite ends of the cross rail 154. The hoisting machines 166 and the hoisting ropes 164 can be operated to raise and lower the cross rail 154.

Machinery 172 or other means are provided for translating the first trolley 142 along the stationary side rails 146. Preferably, the machinery 172 is electrically controlled and operated. A wire rope system 174 is provided between the machinery 172 and the first trolley 142 for translating the first trolley in both directions along the spaced overhead side rails 146.

As shown in FIG. 12, the second trolley 156 incorporates machinery or other means 176 for translating the second trolley 156 in both directions along the cross rail 154. Preferably, the machinery 176 is electrically operated and controlled. The machinery 176 could also be mounted on the cross rail 154.

The second trolley 156 is provided with load carrying means 168 to which any desired load can be connected. The load carrying means 168 are illustrated as comprising a hook 170 but may comprise a spreader bar, a grab bucket or the like, as previously described.

Various components of the overhead traveling crane 140 constitute a pendulum. The bob of the pendulum comprises the cross rail 154, the second trolley 156, the load carrying means 168 and the load connected thereto. The suspension means of the pendulum comprise the hoisting ropes 164. The pivotal support of the pendulum comprises the hoisting machines 166 which are mounted on the transverse structure 160 of the first trolley 142.

Because of the pendulum configuration, the cross bar, the second trolley 156, the load carrying means 168 and the load connected to such means are subject to pendulum swinging movement when the first trolley 142 is started or stopped. However, the cross bar 160, the second trolley 156, the hook 170 and the load can be brought to a complete motionless stop, without any residual swinging movement, by applying the present invention to the machinery 172 for translating the first trolley 142 and to the hoisting machines 166 for raising and lowering the cross rail 160 on which the second trolley 156 is translatably mounted. The present invention can also be applied to the machinery 176 for translating the second trolley 156 in a transverse direction along the cross rail 154.

As previously explained in connection with the container crane 10, the swingably supported components comprising the cross rail 154, the second trolley 156, the hook 170 and the load connected thereto are brought to a complete stop without any residual pendulum swinging movement by stopping the first trolley 142 twice in a rather quick sequence in first and second stopping positions. In FIG. 11, the components are shown in broken lines in the first stopping position and in full lines in the second stopping position.

In accordance with the present invention, the distance between the first and second stopping positions and the time interval therebetween are such as to correspond with the first quarter of the pendulum swinging cycle. More specifically, the distance between the first and second stopping positions of the first trolley 142 corresponds with the horizontal distance through which the bob of the pendulum travels during the first quarter of the swinging cycle of the pendulum. The time interval between the first and second stopping positions corresponds with the first quarter of the full duration of the pendulum cycle.

The overhead crane 140 of FIGS. 11 and 12 can be modified and simplified by combining the cross rail 154 with the cross structure 160 and by arranging the second trolley 156 so that its wheels 158 travel along the cross structure 160. One of the hoisting means 162 is then connected between the second trolley 156 and the hook 170 or some other load carrying device, such as a spreader bar or a grab bucket. In the modified crane, one of the hoisting machines 166 is mounted on the second trolley 156. One set of the hoisting ropes 164 extends between the hoisting machine 166 and the hook 170 or some other load carrying device. As before, the second trolley 156 incorporates or is connected to machinery or other means 176 for translating the second trolley 156 in opposite directions along the supporting structure 160. The machinery 176 can also be mounted on the cross structure 160. The present invention is applied to the modified arrangement in the same manner as described in connection with the overhead crane 140 of FIGS. 11 and 12.

The mounting of the operator's cab 50 on the separate trolley 52 having its rollers 54 supported on the separate rail 56 is an important feature of the present invention, because the cab 50 and the operator therein are not subjected to the disturbing effects of the abrupt stopping of the main trolley 24 whereby the container 34 or other load is horizontally transported, stopped and started. In accordance with the present invention, the operator's cab 50 should not be mounted on the main trolley 24, because the sudden stopping and starting of the trolley 24 might subject the operator to discomfort or injury.

Figure 5:
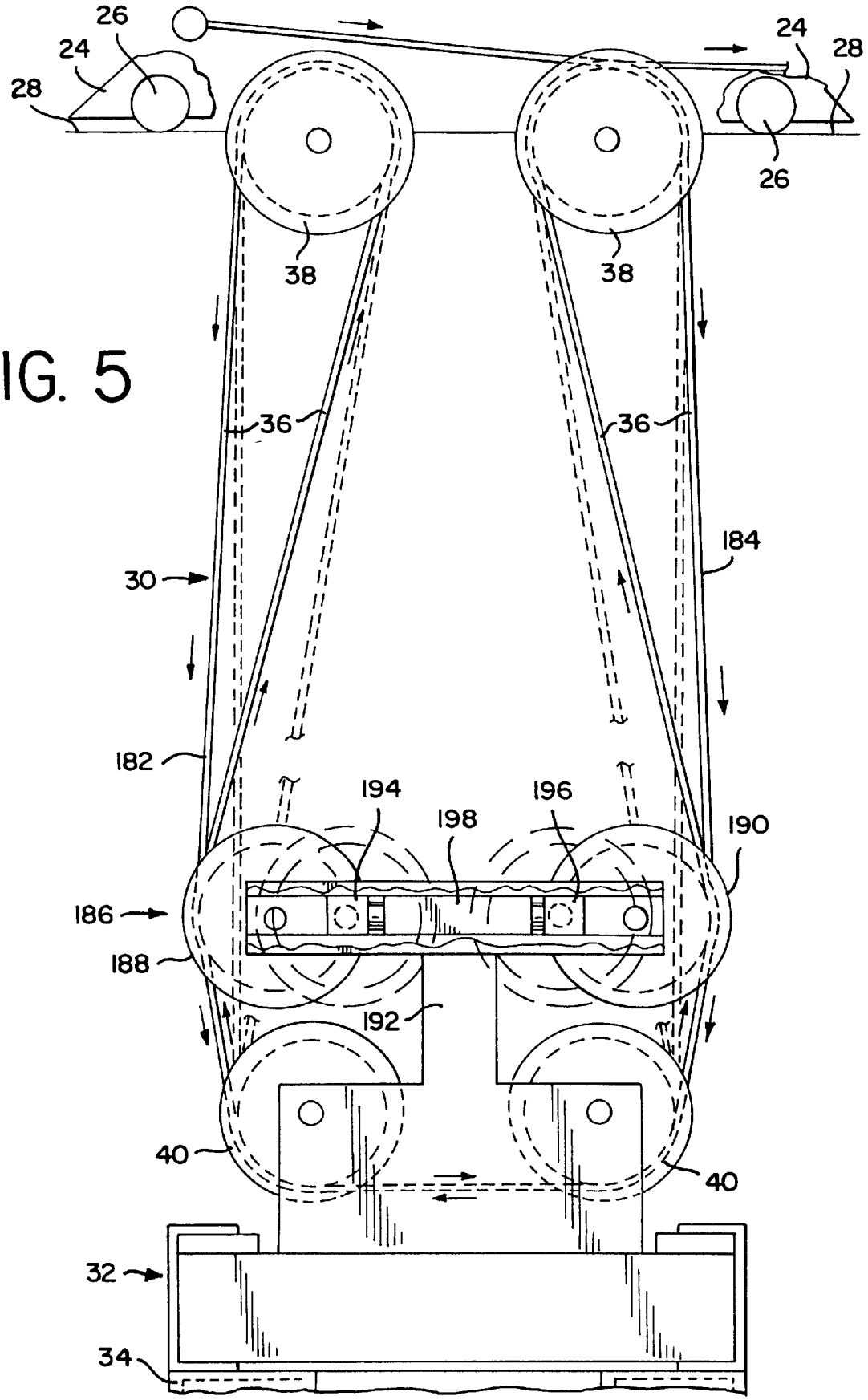
FIG. 5 is a fragmentary enlarged diagrammatic elevational view corresponding to a portion of FIG. 3 and showing the hoisting rope system and the spreader bar device whereby the container is suspended from the trolley.

FIG. 5 illustrates another feature of the present invention, whereby the swaying of the container 34 or other load can be reduced or suppressed, particularly when the container 34 is empty and thus is light in weight, or when the wire ropes 36, forming the suspension means of the pendulum, are particularly short, because the container 34 has been hoisted to a particularly high elevation where the container is to be stopped, or when both conditions exist. As shown in FIG. 5, the wire ropes 36 are trained around a plurality of pulleys 38 on the trolley 24 and a plurality of pulleys 40 on the spreader bar 32. The pulleys 38 are at the same elevation on the trolley 24 but are spaced apart horizontally. Similarly, the pulleys 40 are at the same elevation on the spreader bar 32 but are spaced apart horizontally.

The wire ropes 36 comprise a plurality of horizontally spaced, generally vertical flights 182 and 184 which are trained around the pulleys 38 and 40 and extend therebetween in a generally vertical direction.

In accordance with a feature of the present invention, deflecting or spreading means 186 are provided, preferably on the spreader bar 32, to engage and push against the flights 182 and 184 so as to deflect them and spread them apart at locations along the flights 182 and 184 between the vertically spaced pulleys 38 and 40. The deflecting means 186 could also be located on the trolley 24. However, as shown in FIG. 5, the spreading means 186 comprise a plurality of horizontally spaced pulleys 188 and 190 which are mounted on bracket means 192 on the spreader bar 32 for generally horizontal movement between retracted positions and extended positions. In FIG. 5, the extended positions of the pulleys 188 and 190 are shown in full lines, while the retracted positions are shown in broken lines. As shown in FIG. 5, the pulleys 188 and 190 are slidably mounted by means of a plurality of slide means 194 and 196, slidably mounted on the bracket means 192. The pulleys 188 and 190 are adapted to be moved rapidly between their retracted and extended positions by power means, illustrated in FIG. 5 as a pneumatic power cylinder 198 operable between the slide means 194 and 196. Other power means could be employed.

The power cylinder 198 is preferably controlled by the person serving as the operator of the crane 10. When the pulleys 188 and 190 are in their retracted positions, as shown in broken lines in FIG. 5, the pulleys are entirely out of engagement with the flights 182 and 184 of the wire rope 36. When the operator actuates the power cylinder 198, the pulleys 188 and 190 are moved horizontally in opposite directions away from each other so that they engage the flights 182 and 184 and deflect them outwardly, whereby they are spread apart at locations disposed along the flights 182 and 184 between the pulleys 38 and 40. The spreading of the flights 182 and 184 has the effect of reducing and suppressing any swaying movement of the spreader bar 32 and the container 34, particularly when the wire rope flights 182 and 184 are especially short, or when the container 34 is empty and consequently is light in weight.

When the container 34 or other load is light in weight, the mass of the container may be less than or comparable to the mass of the spreader bar 32, so that the center of mass of the pendulum system is shifted upwardly. The effect of this upward shifting of the center of mass is particularly pronounced when the wire rope flights 182 and 184 are unusually short in length, because the container 34 has been hoisted to an unusually high elevation. The provision of the deflecting means 186 for spreading the flights 182 and 184 affords additional means for reducing and suppressing the swaying movement of the container 34 when the trolley 24 is stopped abruptly.

Various other modifications, alternative constructions and equivalents may be provided without departing from the true spirit and scope of the present invention, as disclosed herein and as set forth in the following claims.

We claim:

1. Apparatus for controlling the operation of a container crane having a generally horizontal boom with at least one rail thereon, a trolley moveable along the rail in opposite directions, hoisting means suspended from the trolley, and load carrying means suspended from the hoisting means for selectively grasping and releasing a load, said apparatus comprising trolley drive control means for causing outward movement of the trolley along the boom, said trolley drive control means comprising stopping means for causing momentary stopping of the trolley at a first stopping position followed by restarting of the trolley in an outward direction, said stopping means subsequently stopping the trolley for a second time at a second stopping position located directly above a transfer position where the load is to be loaded into a container conveyance vehicle and then released from the load carrying means, the stopping of the trolley at the stopping position being operative to cause the load to swing forwardly to initiate the first quarter of a pendulum swinging cycle, means for controlling the location of the first stopping position so that the distance between the first and second stopping positions corresponds with the horizontal component of the swinging movement of the load during the first quarter of the pendulum swinging cycle, and means for propelling the trolley between said first and second positions at a rate such that the trolley catches up with the load at the second stopping position of the trolley, whereby the load is completely stopped at the transfer position without any residual swinging movement.

2. Apparatus according to claim 1, in which the load carrying means are adapted for grasping and releasing a standard freight container, and the transfer position is adapted to be located directly over a selected cell of a container ship for receiving the container.

3. Apparatus according to claim 1, including means for determining the effective length of the pendulum comprising the trolley, the hoisting system, the loading carrying means and the load;

and means for selecting the distance between the first and second stopping positions of the trolley as a function of the effective length of the pendulum.

4. Apparatus according to claim 3, including means for determining the weight of the load and the load carrying means, and means for adjusting the distance between the first and second stopping positions as a function of the weight.

5. Apparatus according to 3, including means for causing the trolley drive control means to adjust the speed of the trolley as a function of the length of the pendulum so that the trolley will catch up with the load at the second stopping position.

6. Apparatus for controlling the operation of a trolley crane having a generally horizontal supporting structure with at least one rail thereon, a trolley moveable along the rail in opposite directions, hoisting means suspended from the trolley and load carrying means suspended from the hoisting means for selectively carrying and releasing a load, said apparatus comprising trolley drive control means for causing outward movement of the trolley along the rail, said trolley drive control means comprising stopping means for causing momentary stopping of the trolley at a first stopping position followed by restarting of the trolley in an outward direction, said stopping means subsequently stopping the trolley for a second time at a second stopping position located directly over a transfer position where the load is to be delivered and released from the load carrying means, the stopping of the trolley at the first stopping position being operative to cause the load to swing forwardly to initiate the first quarter of a pendulum swinging cycle, said trolley drive control means including means for controlling the location of the first stopping position so that the distance between the first and second stopping positions corresponds with the horizontal component of the swinging movement of the load during the first quarter of the pendulum swinging cycle, said trolley drive control means including means for propelling the trolley between the first and second positions at a rate such that the trolley catches up with the load at the second stopping position of the trolley, whereby the load is completely stopped at the transfer position without any residual swinging movement.

7. Apparatus according to claim 6, including means for determining the effective length of the pendulum comprising the trolley, the hoisting system, the load carrying means and the load;

and means for causing said trolley drive control means to select the distance between the first and second stopping positions of the trolley as a function of the effective length of the pendulum.

8. Apparatus according to claim 7, including means for determining the weight of the load and the load carrying means, and means for causing the trolley drive control means to adjust the distance between the first and second stopping positions as a function of the weight.

9. Apparatus according to claim 7, including means for causing the trolley drive control means to adjust the speed of the trolley between the first and second stopping positions as a function of the length of the pendulum so that the trolley will catch up with the load at the second stopping position of the trolley.

10. Apparatus according to claim 6, in which the load carrying means take the form of a grab bucket for selectively picking up, carrying and discharging a load of loose granular bulk material.

11. Apparatus according to claim 6, in which the horizontal supporting structure of the crane comprises first and second side structure components which are spaced widely apart and are provided with first and second substantially horizontal rails thereon, said trolley comprising first and second means for traveling on said first and second rails, and a cross structure extending between said first and second means.

12. Apparatus according to claim 6, in which the horizontal supporting structure of the crane comprises first and second side structure components which are spaced widely apart and are provided with first and second substantially horizontal rails thereon, said trolley comprising first and second trolley components which are simultaneously moveable along said first and second rails, said hoisting system comprising first and second hoisting system components suspended from the first and second trolley components, the crane having an elongated cross member suspended at its opposite ends from the first and second hoisting system components and having at least one cross rail thereon, and a second trolley moveable along the cross rail in opposite directions, the load carrying means being suspended from the second trolley.

* * * * *